US012378758B2

(12) United States Patent
Klabunde

(10) Patent No.: US 12,378,758 B2
(45) Date of Patent: Aug. 5, 2025

(54) SEPTIC SYSTEM INCLUDING CONTROL AND MONITORING SYSTEM

(71) Applicant: Alderon Industries, LLC, Hawley, MN (US)

(72) Inventor: Robert Gordon Klabunde, Frazee, MN (US)

(73) Assignee: ALDERON INDUSTRIES, LLC, Hawley, MN (US)

( * ) Notice: Subject to any disclaimer, the term of this patent is extended or adjusted under 35 U.S.C. 154(b) by 546 days.

(21) Appl. No.: 17/677,504

(22) Filed: Feb. 22, 2022

(65) Prior Publication Data

US 2022/0268010 A1 Aug. 25, 2022

Related U.S. Application Data

(60) Provisional application No. 63/152,370, filed on Feb. 23, 2021.

(51) Int. Cl.

| | |
|---|---|
| ***E03F 5/22*** | (2006.01) |
| ***E03F 5/18*** | (2006.01) |
| ***E03F 11/00*** | (2006.01) |
| ***F04D 15/00*** | (2006.01) |
| ***F04D 15/02*** | (2006.01) |

(52) U.S. Cl.

CPC ..... *E03F 5/22* (2013.01); *E03F 5/18* (2013.01); *E03F 11/00* (2013.01); *F04D 15/0077* (2013.01); *F04D 15/0088* (2013.01); *F04D 15/0218* (2013.01)

(58) Field of Classification Search

CPC ..... E03F 5/22; E03F 5/18; F04D 15/0218

See application file for complete search history.

(56) References Cited

U.S. PATENT DOCUMENTS

| | | | | |
|---|---|---|---|---|
| 4,439,323 | A * | 3/1984 | Ball | B01D 35/0276 210/744 |
| 5,076,763 | A * | 12/1991 | Anastos | H02H 7/08 318/474 |
| 5,198,113 | A * | 3/1993 | Daniels | B01D 29/23 210/449 |
| 5,690,824 | A * | 11/1997 | Stuth | B01D 29/668 210/522 |
| 6,140,925 | A | 10/2000 | Lee et al. | |
| 6,816,088 | B1 * | 11/2004 | Knoska | G07C 5/085 340/459 |

(Continued)

FOREIGN PATENT DOCUMENTS

| | | | | |
|---|---|---|---|---|
| EP | 694694 | A1 * | 1/1996 | F04B 49/06 |
| EP | 3567173 | A1 * | 11/2019 | E03F 5/22 |

(Continued)

OTHER PUBLICATIONS

Specification of inventor Robert G. Klabunde's U.S. Appl. No. 63/152,370, filed Feb. 23, 2021 (Year: 2025).*

*Primary Examiner* — Chester T Barry

(74) *Attorney, Agent, or Firm* — Fredrikson & Byron, P.A.

(57) ABSTRACT

A method of operating a septic system to facilitate maintenance and avoid damage to property and/or the environment. A septic system that collects and monitors data to provide information to a user about the nature of a problem condition, or to warn a user of potential problems in advance, or to recommend courses of action to avoid costly repairs, or property damage, or damage to the environment.

10 Claims, 4 Drawing Sheets

(56) References Cited

U.S. PATENT DOCUMENTS

| | | | | |
|---|---|---|---|---|
| 8,737,672 | B1 | 5/2014 | George | |
| 10,794,379 | B2 | 10/2020 | Guetter | |
| 10,927,829 | B2 * | 2/2021 | Beard | F04B 49/02 |
| 11,425,786 | B2 * | 8/2022 | Khalid | H04W 76/15 |
| 2006/0239777 | A1 * | 10/2006 | Martin | B09C 1/00 405/128.15 |
| 2008/0031752 | A1 * | 2/2008 | Littwin | F04D 13/086 417/411 |
| 2009/0008338 | A1 | 1/2009 | Dunbar et al. | |
| 2009/0050042 | A1 * | 2/2009 | Waldecker | B63J 4/004 340/984 |
| 2012/0251333 | A1 * | 10/2012 | Irwin | E03F 5/22 417/1 |
| 2017/0370369 | A1 * | 12/2017 | Grzeika | G01F 25/22 |
| 2018/0291911 | A1 * | 10/2018 | Ward | F04F 5/10 |

FOREIGN PATENT DOCUMENTS

| | | | | |
|---|---|---|---|---|
| GB | 2139793 | A * | 11/1984 | B63B 13/00 |
| SE | 536111 | C2 * | 5/2013 | E03F 5/22 |
| WO | 2020148541 | A1 | 7/2020 | |

* cited by examiner

| ENCLOSURE LED INDICATOR | SYSTEM FUNCTION DISPLAYED TEXT | DESCRIPTION OF SYSTEM FUNCTION |
|---|---|---|
| Green Continuous | SYSTEM NORMAL | System is Normal |
| Blue Continuous | PUMP RUN | Pump is Running Normal |
| Red/Blue Alternating | EXT PUMP ALARM | Alarm - Pump is Running Continuously; Check Pump Float or Broken Pipe |
| Purple/Blue Alternating | HIGH AMP ALARM | Alarm - Pump is Drawing High Amps, Check Pump and Pump Blockages |
| Purple Flashing | PUMP FAILURE | Alarm - Pump is NOT Drawing Amps: Check Pump Float and Pump, Press Menu to Clear Fault |
| Purple/Red Alternating | PUMP FAILURE/HIGH LVL ALARM | Pump is NOT Drawing Amps/Tank is Full; Check Pump Float and Pump. Press Menu to Clear Fault |
| Red Flashing | HIGH LVL ALARM | Tank is at High Level; Check Pump Float and Pump |
| Amber Flashing | FILTER ALARM | Filter needs Cleaning; Check Effluent Filter |
| White/Cyan Alternating | UI ERROR (event: not displayed) | Faceplate or OLED Screen not connected to Circuit Board; Check Ribbon for Proper Connection |

FIG. 5

| PROBLEM | PROBABLE CAUSE | SOLUTION |
|---|---|---|
| Green LEDs on the enclosure are not turning on during initial setup | Power not applied or power loss | Check to see if unit is plugged in, have qualified personnel check receptacle with voltmeter and make sure circuit breaker is not tripped; during a power loss event the OLED screen will display PWR LOSS ALARM (page 17) |
| | Green LED turn off feature activated | See page 22 for programming LED on and off feature |
| The pump is running continuously | Check to see if the pump float switch is hung up on something | Make sure the pump float switch is free and the line is tethered at desired location in a secure fashion |
| | If the pump float switch is old, the contacts could be stuck shut | Replace the pump float switch |
| | Broken discharge pipe | Repair or replace discharge pipe |
| The pump is drawing high amps | Check to make sure there's no damage to the pump and it's operating property | Service or replace the pump |
| | Check to see if there are any blockages to the pump | Clear blockage to resume normal pump operation |
| The pump is not drawing amps | Check to make sure there's no damage to the pump and it's operating property | Service or replace the pump |
| | Check to see if the pump float switch is hung up on something | Make sure the pump float switch is free and the line is tethered at desired location in a secure fashion |
| | If the pump switch is old, the contacts could be stuck open | Replace the pump float switch |
| While using an alarm float switch the alarm conditions are resuming with an empty tank | Check to see if the alarm float switch is hung up on something | Make sure the alarm float switch is free and the line is tethered at desired location in a secure fashion |
| | If the alarm float switch is old, the contacts could be stuck shut | Replace the alarm float switch |
| The alarm float switch is activated, the red LEDs on the enclosure are flashing and the buzzer is not annunciating | The test/silence pushbutton has been pressed | Deactivate or disconnect the alarm float switch and then reactivate or reconnect the alarm float switch to ensure normal operation resumes (pages 9 and 19) |
| While using a filter switch, the alarm conditions are resuming with a clean effluent filter | Check to see if the filter switch has debris or material build up | Clean filter switch enclosure and float to resume normal operation |
| The filter switch is activated, the amber LEDs on the enclosure are flashing and the buzzer is not annunciating | The test/silence pushbutton has been pressed | Deactivate or disconnect the filter switch and then reactivate or reconnect the filter switch to ensure normal operation resumes (pages 9 and 19) |
| The white and cyan LEDs on the enclosure are alternating every second, no text is displayed on the OLED screen and alarm buzzer is not annunciating | The faceplate or OLED screen are not properly connected to the main circuit board (UI Error event) | Make sure the ribbon from the faceplate to the main circuit board has a secure connection, consult factory if the error remains after checking ribbon |

FIG. 6

SEPTIC SYSTEM INCLUDING CONTROL AND MONITORING SYSTEM

CROSS-REFERENCE TO RELATED APPLICATIONS

This application claims the benefit of U.S. Provisional Application No. 63/152,370, filed Feb. 23, 2021, the contents of which are incorporated herein by reference.

TECHNICAL FIELD

This disclosure relates generally to systems and/or methods for operating septic tanks and related systems to facilitate maintenance of the system and to avoid damage to property and/or the environment. More particularly, this disclosure describes embodiments of a septic system that collects and monitors data to provide information to a user about the nature of a problem condition, or to warn a user of potential problems in advance, or to recommend courses of action to avoid costly repairs, or property damage, or damage to the environment.

BACKGROUND

Septic systems often include a septic tank, a drainfield (sometimes called a leach field or absorption field), a pump, and a pump power source. Some systems may include a pump controller and a high liquid level alarm. In some cases, the high liquid level may warn of a pump failure, or of a high liquid level that if not remedied could lead to sewage backup into a home or other type of building. Additional components may be added to the septic system, such as a pump elapsed time meter, pump counter, and/or a filter alarm; these items may be added in response to state or county requirements, for example. A drainfield or mound system that receives the pump discharged effluent may be limited in its ability to absorb only a certain number of gallons per day; exceeding this limit may possibly lead to failure of the drainfield mound system, which may be very expensive to repair, and may also result in damage to the environment.

For monitoring the amount pumped (e.g., in gallons), a pump elapsed time meter is often used to record total pump run time in hours and tenths of hours. On a periodic basis (e.g., monthly) an inspector will use the total elapsed time for the month and, by calculating "gallons per minute" for the pump system, the inspector can determine gallons pumped for the month and then calculate a daily average. A similar calculation can be done with a pump counter that will count how many times the pump started and, by knowing the "gallons per pump cycle," the monthly gallons/daily average can be calculated as well.

A high-level alarm in a septic system indicates to a user/owner that the liquid level in the septic tank is at a high level in the tank. This could possibly mean that the pump failed, or that the amount of sewage and wastewater is coming into the tank faster than the pump is able to pump it out, or possibly other reasons.

In some septic systems, a filter alarm is used. A filter is often used to help protect the drainfield from solids being pumped from the septic tank out to the drainfield. The filter screens out small solids before the effluent enters the "pump chamber." If such a filter becomes plugged, the liquid level in the tank will increase. A high-water float switch is typically positioned at a level where the "filter switch alarm" is activated in this circumstance, telling the user/homeowner that the filter must be removed, cleaned, and put back into service. If this is not done, the liquid level will continue to increase and will eventually lead to sewage backing up and flooding the home.

In summary, conventional systems may warn of a high liquid level, or warn if a filter is plugged, and/or record certain pump operating information, such as the total amount of time the pump has run or the number of times it has started.

SUMMARY

A septic system monitoring and control system as described in this disclosure can detect pump and system issues, and may further be able to facilitate identification of a cause. For example, some embodiments of this disclosure may be able to attribute problem conditions in a septic system to human misuse or overuse, or to installation errors, or to wearing/aging equipment, or to equipment failures such as pipes plugging or breaking, as possible examples. Knowing more about the nature of these conditions as early as possible may potentially save a user/homeowner thousands of dollars in repairs or replacement, as well as preventing harm to the environment. In some particular embodiments, the system may include an alarm/control unit mounted on a 5"×5"×42" high PVC plastic post (with custom heights available), for example. Portions of the system may, for example, conveniently attach to a riser of a pump chamber tank in some embodiments, potentially eliminating the need for installation of a conventional and costly control panel.

Methods of operating a septic system are disclosed herein. A method of operating a septic system may include providing a septic system that includes: a septic tank configured to receive sewage from a structure, an effluent receiving area, and a pump configured to move the sewage from the septic tank to the effluent receiving area. A method may include operating the pump to begin pumping the sewage from the septic tank to the effluent receiving area when the fluid level in a portion of the septic tank reaches an upper pump level setting, and continue pumping until the fluid level falls to a lower pump level setting, at which point pumping is discontinued. A method may include measuring one or more performance metrics including the elapsed time of a pump run cycle (e.g., the time to pump from the upper pump level setting to the lower pump level setting), the amount of electrical current used by the pump during a pump run cycle, and the number of pump run cycles that have occurred. A method may include alerting a user of a condition of the septic system based on one or more of the measured performance metrics exceeding a predetermined setting.

A septic system is disclosed herein. A septic system may include a septic tank configured to receive sewage discharged from a structure, an effluent receiving area, a pump configured to move the sewage from the septic tank to the effluent receiving area, and a control and monitoring system. The control and monitoring system may be configured to operate the pump to begin pumping the sewage from the septic tank to the effluent receiving area when a fluid level in the septic tank reaches an upper pump level setting, and continue pumping until the fluid level in the septic tank falls to a lower pump level setting, at which point pumping is discontinued. The control and monitoring system may be further configured to measure one or more performance metrics, which may include the elapsed time to pump during a pump run cycle (from the upper pump level setting to the lower pump level setting), the amount of electrical current used by the pump when pumping during a pump run cycle, and the number of pump run cycles. The control and monitoring system may be further configured to alert a user of a condition or problem regarding the septic system based on one or more of the performance metrics exceeding a predetermined setting.

BRIEF DESCRIPTION OF DRAWINGS

FIG. 5 is a table showing an exemplary colored lighting scheme to indicate system and/or alarm conditions in accordance with an exemplary embodiment of this disclosure.

FIG. 6 is a table showing an exemplary trouble-shooting guide for a septic system in accordance with an exemplary embodiment of this disclosure.

DETAILED DESCRIPTION

Figure 1:
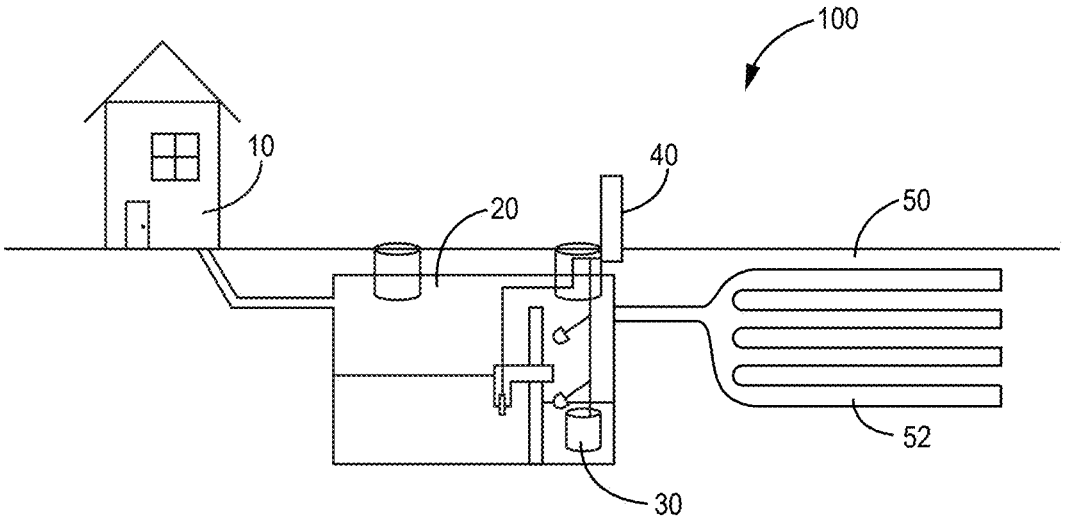
FIG. 1 is a schematic diagram of a septic system according to some embodiments of this disclosure.

FIG. 1 is a schematic diagram of a septic system 100 comprising a septic tank 20 configured to receive sewage and/or wastewater from home or building structure 10. Septic tank 20 includes a pump 30 configured to pump the contents of the tank 20 to a drainfield or mound area 50, also referred to herein as an effluent receiving area 50. Drainfield 50 may include a series of lateral pipes 52 which branch out from the main discharge pipe and distribute the effluent discharge beneath the ground surface of the drainfield 50. The lateral pipes may include perforations, for example, to distribute the effluent discharge into a filter bed, for example. Also shown in FIG. 1 is a control and monitoring system 40 for controlling and monitoring various aspects of the operation of septic system 100.

Figure 2:
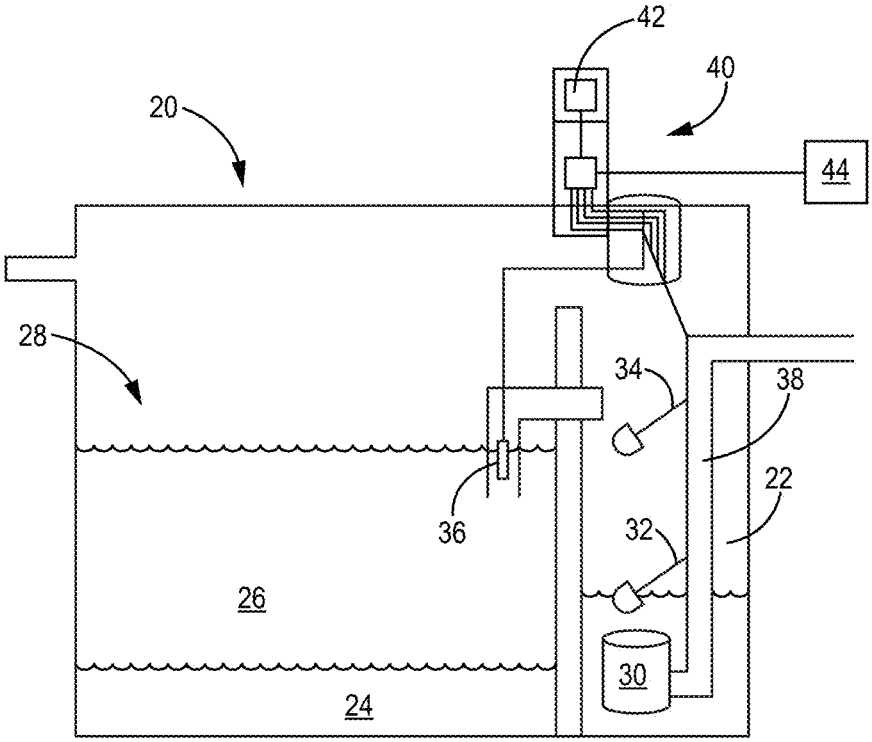
FIG. 2 is cross-sectional side view of a septic tank according to various embodiments of this disclosure.
Figure 4:
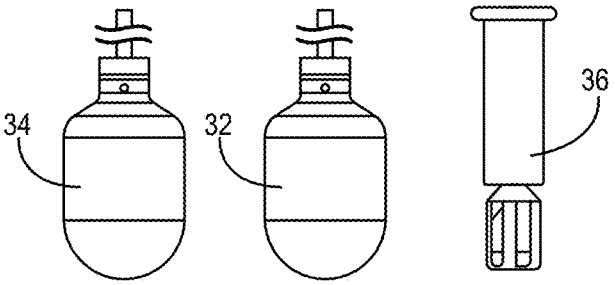
FIG. 4 is a series of enlarged views of exemplary switches that may be used according to some embodiments of this disclosure.

FIG. 2 is cross-sectional side view of a septic tank 20 according to some embodiments of this disclosure. For example, septic tank 20 has a first chamber 28 where the sewage and wastewater received from building 10 are stored and settle into a sludge layer 24 and a liquid layer 26 as shown in FIG. 2. Septic tank 20 also has a pump chamber 22, and the pump 30 is disposed in the pump chamber 22. Pump chamber 22 is configured to receive liquid effluent from the first chamber 28 of septic tank 20. A filter switch 36 is shown disposed in a conduit between the first chamber 28 and the pump chamber 22. The filter associated with filter switch 36 is configured to prevent solids from entering pump chamber 22. In addition to pump 30, pump chamber 22 includes pump float switch 32 and alarm float switch 34. When the pump float switch 32 is activated (e.g., by the fluid level in the pump chamber 22 rising to an upper pump level setting to thereby activate pump float switch 32), pump 30 will turn on and pump the contents of pump chamber 22 to the effluent receiving area or drainfield system 50 via pump discharge pipe 38. Pump 30 will run in this manner until turned off by deactivation of pump float switch 32 (e.g., when the fluid level measured in the pump chamber 22 is lowered to a lower pump level setting to thereby deactivate pump float switch 32). It should be noted that the function of pump float switch 32 could be performed in a variety of alternate ways. For example, a transducer or a level measuring device (e.g., electronic, optical, etc.), as are known in the art, could be used to signal pump 30 to turn on and turn off at predetermined levels (e.g., an "ON" level at which pump 30 turns on, and an "OFF" level at which pump 30 turns off, the ON level being higher than the OFF level). Alarm float switch 34 will trigger an alarm condition at control and monitoring system 40 if the liquid level in pump chamber 22 rises sufficiently to activate alarm float switch 34. As with the pump float switch 32, the function of the alarm float switch 34 could alternately be performed using a transducer or a level measuring device (e.g., electronic, optical, etc.), as are known in the art, to identify the occurrence of a high-level condition at a pre-determined level in the pump chamber 22 (e.g., an "ALARM" level that is higher than the aforementioned ON level or upper pump level setting). FIG. 4 shows enlarged views of exemplary embodiments of alarm float switch 34, pump float switch 32, and filter switch 36 that may be used with some embodiments of this disclosure.

Filter switch 36 will trigger an alarm condition at control and monitoring system 40 if the liquid level in first chamber 28 rises sufficiently to activate filter switch 36, indicating that the filter needs cleaning or maintenance or replacement. Control and monitoring system 40 may comprise a display console 42 for displaying information to a user/homeowner about the status of the septic system 100, or about alarm conditions, or operational statistics about the septic system 100, etc., according to some embodiments. A visible alarm, for example, may comprise one or more colored lights, or an alarm code, or a text description that provides information about the nature of the alarm condition. For example, display console 42 may comprise one or more lights with colors to indicate a variety of alarms or conditions of septic system 100. The lights may include RGB-type LED lights to produce a variety of colors that are each specific to a certain condition or alarm. Display console 42 may also include a text readout that can provide an explanatory message about the nature of the condition or alarm. As an example, FIG. 5 is a table showing an exemplary colored lighting scheme to indicate a variety of system and/or alarm conditions in accordance with an exemplary embodiment of this disclosure. For example, for a Red Flashing light condition in FIG. 5, a text message may also appear on display console 42, "HIGH LVL ALARM," and the corresponding description of this condition is that, "Tank is at High Level; Check Pump Float and Pump."

FIG. 2 also shows a power source 44 that is configured to supply electrical power to various components of septic system 100. For example, power source 44 may provide the electrical power (either directly, or indirectly via control and monitoring system 40) needed to run pump 30, and to operate and activate signals to and from a number of switches including pump float switch 32, high level alarm switch 34, and filter switch 36, and for the operation of control and monitoring system 40. A breaker (not shown) may be in-line with power source 44 to control the supply of electrical power and/or to interrupt the supply of electrical power in errant conditions.

Figure 3:
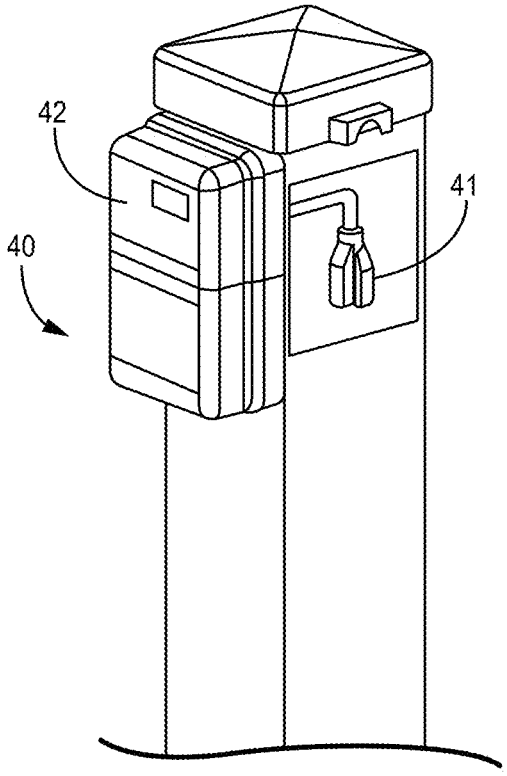
FIG. 3 is a perspective view of a control and monitoring system to some embodiments of this disclosure.

FIG. 3 is a perspective view of control and monitoring system 40 according to one exemplary embodiment. Display console 42 is shown as part of control and monitoring system 40, although they need not be integrated into a single unit as shown. Display console 42 in FIG. 3 includes a display screen and user interaction controls (buttons). The screen may provide for a text readout that can provide an explanatory message about the nature of the condition or alarm. FIG. 3 also shows a power receptacle 41 for receiving electrical power from power source 44. In the exemplary embodiment shown, power receptacle 41 is a female power receptacle rated at 15 Amps, for example. It should be noted that, due to the higher electrical current requirements of pump 30 as compared to the electrical requirements of other system components, power source 44 may supply power to pump 30 separately from the other components. This may be beneficial, for example, in a condition where pump 30 draws excessive electrical current and trips a breaker that only affects power to pump 30; the remaining components would continue to have power supplied from power source 44, or alternatively, via a battery back-up associated with control and monitoring system 40, for example.

Control and monitoring system 40 may comprise a processor (e.g., a microprocessor), as are known in the art, along with integrated circuitry comprising and/or interconnecting memory modules (e.g., RAM, ROM, ePROM, etc.), software, firmware, input/output devices, etc. Control and monitoring system 40 may be configured to facilitate the collection of data about the operation of septic system 100, and such data may be useful in diagnosing issues or problems with system 100. Such data may possibly even be used to prevent certain problems from occurring, or to lessen their severity, by helping to identify trends or to anticipate issues. Examples of the types of data that may be collected by control and monitoring system 40 include data about the normal functioning of pump 30, or about alarm conditions related to either the pump 30, or filter 36, or about other aspects of the system 100. A processor of control and monitoring system 40 may be configured to store data regarding one or more of the performance metrics. The processor may be further configured to alert the user/homeowner when a performance metric exceeds a predetermined setting. Such data may include, but is not limited to, the following types of data or information:

- the amount of electrical current used by pump 30 during operation (e.g., measured in Amps);
- the amount of elapsed time needed for pump 30 to bring the level in pump chamber 22 down from an ON level to an OFF level (e.g., during a pump run cycle);
- a count of the number of pump run cycles that have occurred;
- a count of the number of high liquid level alarms that have occurred; and
- a count of the number of filter switch alarms that have occurred.

Further, the above types of data, once collected by control and monitoring system 40, may be processed by a processor of control and monitoring system 40 to produce additional information or forms of data, such as average values, maximum values, minimum values, and event counter values associated with the performance metrics. For example, during a given pump run cycle, the electrical current used by pump 30 could be processed to provide Average, Minimum, and Maximum values of current used. This type of processing could be extended to provide Average, Minimum, and Maximum values of current over longer periods of time, such as days, weeks, months, years, etc. Similarly, during a given pump run cycle, the amount of time needed for pump 30 to bring the level in pump chamber 22 down from an upper setpoint to a lower setpoint level could be processed to provide Average, Minimum, and Maximum values of elapsed time, and the analysis could be extended to provide Average, Minimum, and Maximum values of elapsed time over longer periods of time, such as days, weeks, months, years, etc. In a similar fashion, control and monitoring system 40 may be configured to process data about the counts or occurrences (e.g., of pump run cycles and/or alarms) and calculate rates or frequencies of such occurrences, such as 3 pump run cycles per day, or 2 filter alarms per year, as possible examples.

It should be noted that electrical current is provided as an exemplary operating parameter for monitoring the operating condition of pump 30. In alternate embodiments, a different parameter could be chosen to perform a comparable monitoring function, such as electrical power used by pump 30 (measured in Watts), or discharge pressure at an outlet of pump 30, as possible examples. In each case, these parameters would likely present a fairly steady "normal" operating range for the given parameter, but a significant sudden change in any of these parameters would provide an indication of a potential problem, and thus, these alternate parameters may be used instead of electrical current according to some embodiments.

Additional examples of data that may be produced by manipulating data received by control and monitoring system 40 could include, for example, data about the number of gallons pumped by pump 30, or data about a subset of the data received that meets certain criteria. In the case of computing the gallons pumped, this may be performed using a straightforward multiplication of elapsed running time by an assumed pump capacity (e.g., based on the rating of the pump, for example) to obtain the number of gallons pumped. In the case of creating a subset of data, a particular example might include defining a setpoint for an "extended" elapsed run time needed by pump 30 to bring the level in pump chamber 22 down from an upper setpoint to a lower setpoint level. This setpoint could further be used to trigger an alarm (an "extended pump run alarm") and/or trigger the separate classification and analysis of the data associated with that particular pump run cycle. For example, data about the electrical current used by pump 30 during an extended pump run alarm could be saved separately and processed similarly to that for "normal" pump operations, including the calculation of minimum, maximum, and average current values during such extended pump run alarms. Likewise, data about the elapsed time during an extended pump run alarm could be saved separately and processed similarly to that for "normal" pump operations, including the calculation of minimum, maximum, and average current values during such extended pump run alarms. The number (counts) of extended pump run alarms could be saved, stored, and/or processed to determine frequency and related types of statistics as well.

In some embodiments of this disclosure, the additional information calculated by the processor about one or more of the performance metrics includes identifying an alarm condition based upon detecting a variance of one of the performance metrics from a corresponding average value, maximum value, minimum value, event counter, or a logical combination of these values, wherein the variance is greater than a predetermined threshold.

Saving and processing the types of data described above may enable the control and monitoring system 40 to provide diagnostic information to a user or homeowner that goes beyond the presentation of a simple alarm condition. In some embodiments, control and monitoring system 40 may be configured to apply and/or identify logical patterns in the data that point to a likely cause and/or solution or recommendation for a given condition.

A series of examples is provided to illustrate how the control and monitoring system 40 of septic system 100 may be used to diagnose issues and/or recommend courses of action to better operate and maintain septic system 100 in a way that could avoid costly repairs, or damage to property and/or the environment. For example, the table in FIG. 6 provides an exemplary trouble-shooting guide for a septic system in accordance with an exemplary embodiment of this disclosure that guides a user/homeowner from an identification of a condition or problem, to a probable cause and a recommended course of action.

Problem 1: "Ponding" of sewage and/or wastewater at the surface of a drainfield (leach field) or mound system may be an indication of an over-pumping condition. If ponding has occurred, the drainfield has failed and will likely result in expensive repairs and/or replacements, and may cause contaminated liquids to get into the surrounding environment (e.g., lakes, rivers, streams, ditches). In a situation like this, data from control and monitoring system 40 may be useful in determining where potential fault or liability could lie. For example, overpumping and the resultant ponding could be due to homeowner misuse (e.g., exceeding a daily maximum allowable gallons of effluent pumped to the system), or it could be due to an installer/contractor making errors in the planning and/or installation process (e.g., designed too small for the expected usage, or installed using incorrect dimensions or wrong materials, etc.).

Solution 1: A septic system 100 with a control and monitoring system 40 as described herein can detect an over-pumping condition by identifying and/or analyzing "Extended Pump Run Alarms." Control and monitoring system 40 can, for example, monitor and/or display electrical current used by pump 30 (e.g., amperage) with setpoints of high and low amps to determine whether the pump is working properly and pumping effluent to the effluent receiving area 50. A pump run event (a "Pump Cycle") where the pump turns on and turns off can be created by using a pump float switch, transducer, or any electronic level measuring device that will turn on the pump at a predetermined level and turn off at a pre-determined level. The system can record the elapsed time it takes to complete a Pump Cycle. The system can also have a setpoint for an "Extended Pump Run Time." By knowing the average time it takes to complete a normal Pump Cycle and knowing the Maximum and Minimum Pump Cycle Times, one can calculate or estimate or manually enter in a setpoint to identify, track, alarm, and log data associated with Extended Pump Run Alarms. As an example, assume a septic system 100 with a control and monitoring system 40 collects data showing that an Average Pump Cycle elapsed time is 60 seconds, a Minimum recorded Pump Cycle elapsed time is 57 seconds, and a Maximum recorded Pump Cycle elapsed time is 65 seconds. One could manually enter "70 Seconds" as a setpoint that will activate an "Extended Pump Run Alarm," according to some embodiments. Once the Extended Pump Run Alarm setpoint is established, anytime the pump cycle takes 70 seconds or longer, an alarm is generated. It is also contemplated that a setpoint for the Extended Pump Run Alarm could be calculated by control and monitoring system 40, for example, by adding a certain percentage of time to the Average Pump Cycle elapsed time, and/or by ensuring that the setpoint is at least a predetermined amount of time greater than the Maximum Pump Cycle elapsed time, or various logical combinations of such criteria.

Continuing the above example, the control and monitoring system 40, after identifying that an event meets the criteria for Extended Pump Run Alarm, can proceed to measure, record, calculate, and log data about the Extended Pump Run Alarm, for example by counting the number of events that have occurred, determining total amounts of time the event has occurred for current and/or accumulative events, and by providing data about the most recent event, as well as average, maximum, and minimum values of data for the events that have occurred. From some of these data, a total value of gallons pumped during the Extended Pump Run Alarms may also be calculated (e.g., using pump flow rate estimates and multiplying by elapsed run times, for example). If ponding of the drainfield/mound has occurred and there are no "Extended Pump Run Alarms," then there is most likely a problem with the system (e.g., the design of the system is not adequate to handle the effluent discharge requirements). On the other hand, if there are more than the expected number of Extended Pump Run Alarms during a given period of time, then it is more likely that the homeowner is overusing the system (e.g., exceeding the capacity of the system). The overuse could, for example, be due to a number of factors, such as more people at the home/structure than the system was designed for, or leaky toilets/faucets, or overuse of a water sump pump that empties to the septic tank, or excessive laundry discharge as possible factors/causes.

In summary, an overloaded septic system 100, which may eventually result (or which has already resulted) in ponding at the drainfield system 50 for example, may be detected by establishing and identifying Extended Pump Run Alarms, and monitoring data regarding electrical current used by the pump 30 and Pump Cycle elapsed times associated with the Extended Pump Run Alarms. If the data regarding electrical current indicates pump 30 is operating normally, while data regarding Pump Cycles (elapsed times, counts, etc.) show excessive usage, an over-pumping condition likely exists. Further data analysis may comprise, for example, determining the total gallons pumped during the Extended Pump Run Alarms, which may be helpful in determining the root cause or fault for the condition. In some cases, control and monitoring system 40 may enable a user/homeowner to identify an over-pumping condition before ponding occurs at the drainfield system 50, which could prevent harm to the local environment and/or potentially save large sums of money in repair or remediation measures. In some embodiments, control and monitoring system 40 may be further adapted to generate a communication signal regarding the Extended Pump Run Alarm Log, for example, providing information about the condition via an internet-based monitoring service, or email, or text message, or phone call, for example, such information possibly including a date/time stamp, explanatory text about the nature of the condition, etc.

Summary of Solution 1: Detect an overloading (over-pumping) condition in the septic system by monitoring pump electrical usage (e.g., electrical current measured in amps), and by identifying pump run times that have exceeded normal pump run cycle times (e.g., by some predetermined threshold amount) and activating an "Extended Pump Run Alarm." Collection of the following items of data may facilitate root cause analysis:

a. Record maximum amps for last extended pump run alarm
b. Record minimum amps for last extended pump run alarm
c. Record average amps for last extended pump run alarm
d. Record elapsed time for last extended pump run alarm
e. Record maximum elapsed time for extended pump run alarm
f. Record minimum elapsed time for extended pump run alarm
g. Record average elapsed time for extended pump run alarm h. Record cumulative elapsed time in extended pump run alarm
i. Record counts for extended pump run alarms activated
j. Record total gallons pumped while in extended pump run alarm
k. Log same information to Internet monitoring service to include Time and Date Stamp and Text, Email, Phone Call.

Problem 2: A broken (e.g., damaged, ruptured, disconnected, etc.) pump discharge pipe 38 within the pump chamber 22 may result in pump 30 running indefinitely. For example, if pump 30 is activated by pump float switch 32 causing pump 30 to turn on while the discharge pipe 38 is broken, the pump will begin running and will pump the liquid effluent to the "broken" pipe, which will cause the liquid to spill out and never leave the pump chamber 22. In this condition, the pump 30 will be unable to reduce the level in pump chamber 22 to the lower level setpoint, and pump 30 may continue running for an excessively long period of time. If the user/homeowner is gone for long periods of time, this could result in damage to pump 30 and will likely result in high electricity usage charges. Several ways in which water and/or other liquids may continue to enter pump chamber 22 even while a homeowner is gone include: leaky toilets, sinks, water systems, rain or thawing snow entering leaky septic tank covers, etc. Several reasons for a pump discharge pipe 38 to fail inside a pump chamber 22 may include: frozen pipes in discharge line leading to drainfield 50, mechanical failure of a connection device associated with pump discharge pipe 38, and mechanical pump vibration leading to a broken pump discharge pipe 38, as possible examples.

Solution 2: A broken pump discharge pipe 38 may be identified as a potential problem when an "Extended Pump Run Alarm" is activated, and when the elapsed pump run cycle time during the alarm condition far exceeds the set point that activated the "Extended Pump Run Alarm." For example, the setpoint for the "Extended Pump Run Alarm" may have been determined (as described previously) by calculating a 50% increase over a "normal" pump run cycle time (e.g., the Average Pump Cycle time using an average over several weeks or several months, etc.). In the case of a broken discharge pipe 38, however, it is possible that the pump 30 may run continuously or nearly continuously. Thus, an identifying characteristic of a broken discharge pipe 38 may comprise an elapsed Pump Cycle time during an "Extended Pump Run Alarm" that is more than a predetermined multiple of the Average Pump Cycle time, for example, more than five times longer than the Average Pump Cycle time. By looking at the total elapsed time for the most recent Pump Cycle event, the elapsed time will far exceed the normal Pump Cycle time when there is a broken discharge pipe 38.

Example: The normal Pump Cycle Time (e.g., the Average Pump Cycle time) is 60 seconds for a given septic system 100 (e.g., this may be an average calculated over the past several weeks, months, or over a year or more. If the elapsed time of the "Extended Pump Run Alarm" is recorded to be 2 days, 4 hours, and 58 seconds, it may be concluded that there was a broken discharge pipe 38 or a similar mechanical failure that results in the pump running, but the effluent waste never leaving the pump chamber 22. In some embodiments, it may be helpful to confirm this conclusion by also monitoring electrical usage of pump 30 (e.g., pump current in amps) and determining that the pump is operating normally (e.g., average pump current during the most recent pump run event is within a certain range of a longer-term average current values) during the "Extended Pump Run Alarm."

Summary of Solution 2: A broken discharge pipe 38 or other similar mechanical failure within pump chamber 22 may be detected by identifying an elapsed pump run cycle time that far exceeds the normal or average pump run time cycle time (e.g., following activation of an "Extended Pump Run Alarm," for example. In conjunction with an excessive pump run cycle time, monitoring electrical usage of pump 30 (e.g., pump current in amps) and determining that the pump is also operating normally (e.g., average pump current during the most recent pump run event is within a certain range of a longer-term average current) may help confirm the presence of a broken discharge pipe 38, for example.

a. Record amps for last extended pump run alarm
b. Record maximum amps for last extended pump run alarm
c. Record minimum amps for last extended pump run alarm
d. Record average amps for last extended pump run alarm
e. Record elapsed time for last extended pump run alarm
f. Record maximum elapsed time for extended pump run alarm
g. Record minimum elapsed time for extended pump run alarm
h. Record average elapsed time for extended pump run alarm
i. Record cumulative elapsed time in extended pump run alarm
j. Record counts for extended pump run alarms activated
k. Record total gallons pump while in extended pump run alarm
l. Log same information to Internet monitoring service to include Time and Date Stamp and Text, Email, Call Problem 3: The lateral pipes 52 that extend from discharge pipe 38 to the effluent receiving area 50 (e.g., drainfield or mound 50) may become broken or plugged. If too many solids are included in the effluent discharge and reach the drainfield 50, for example, the lateral pipes 52 may start to clog. The lateral pipes 38 can also become broken by movement of the earth or by driving vehicles over the drainfield 50, for example. If not detected early and repaired, the septic system 100 may start ponding at the drainfield 50, indicating failure of the septic system 100.

Solution 3: When lateral pipes 52 in drainfield 50 become plugged, blocked, or broken, both the electrical usage of the pump 30 (e.g., pump current in amps) and the pump run cycle times will change. By using monitoring and control system 40 to process data regarding electrical usage of pump 30 (e.g., pump current) and elapsed pump run times, a problem with a broken or plugged lateral pipe 52 may be identified. For example, during an "Extended Pump Run Alarm" where drainfield 50 has 4 lateral pipes, and one of the 4 pipes becomes plugged or blocked, there will only be 3 remaining lateral pipes for the pump 30 to discharge to. As a result, the pump 30 will draw less electrical current during a given pump run cycle, but the elapsed pump run cycle time will increase (e.g., it will take longer to pump the same amount of effluent from pump chamber 22) since there are only 3 lateral pipes to discharge to. The setpoint for determining a lower than normal amount of electrical current may be based on a percentage change from a normal value, for example, by establishing a setpoint for low current at 25% below an Average value of pump electrical current during a pump run cycle. Similarly, the setpoint for determining a higher than normal pump cycle run time may be based on a percentage change from a normal value, for example, by using the same setpoint as used for the Extended Pump Run Alarms, or by defining an additional setpoint. In short, by identifying a condition that includes lower than normal electrical current used by the pump, and an Extended Pump Run Alarm condition, it may be concluded that the septic system 100 has one or more plugged, clogged, or broken lateral pipes 52 in the effluent receiving area (e.g., drainfield 50).

Summary of Solution 3: Detecting a broken or clogged pipe from the pump discharge out to drainfield/mound laterals by monitoring low amps and extended pump run alarms.

a. Monitor amps for trends showing amps decreasing
b. Monitor pump run times for trends increasing
c. Log same information to Internet monitoring service to include Time and Date Stamp and Text, Email, Call Problem 4: Solid waste can enter the pump chamber 22 and can eventually cause damage to the pump 30, and if the solids enter the lateral pipes 52 in the drainfield 50, they can plug and cause a deteriorating and failed system. Often times, the first septic tank compartment (e.g., first chamber 28) may not be maintained properly, and the sludge layer 24 may build-up and the level may increase in the chamber 28 to the point where solids will enter into the pump chamber 22. Other solids can be from cigarette packages, tampons, condoms, rags, etc.

Solution 4: The presence of solids in pump chamber 22 may be detected by monitoring for higher than normal electrical usage by pump 30, for example, by detecting that electrical current (typically measured in amps) used by pump 30 during a pump run cycle is higher than an Average current level, possibly by some predetermined margin. By monitoring current values used by pump 30 during normal operations, and determining minimum, maximum, and average values for pump electrical current during normal pumping, one can determine (or the control and monitoring system 40 can calculate) a high current alarm setpoint to be detected by the system. The high current alarm, when triggered, may cause control and monitoring system 40 to collect other data associated with the high current alarm event, such as data about pump run cycle times, etc.

Example: During normal pump operations, using data collected by control and monitoring system 40, it is determined that the Average value of electrical current used by pump 30 during a pump run cycle is 7.0 Amps. During the corresponding period of time for calculating the Average current value, it is also determined that the Minimum current level was 6.8 Amps, and the Maximum current value was 7.2 Amps. In this example, a setpoint of 7.4 Amps might be chosen for a high current alarm setpoint; accordingly, if the amount of current used during a given pump run cycle increases to 7.4 Amps or more, an alarm may be initiated, and/or it may be concluded (or at least suspected) that solids are present in pump chamber 22 and that pump 30 is attempting to pump the solids.

Summary of Solution 4: The presence of solids in pump chamber 22 may be detected as the solids are pumped by pump 30 to drainfield/mound system 50 by logging and/or monitoring pump electrical current (Amps) during normal pump operations to determine "normal" Minimum, Maximum, and Average values for electrical current drawn by pump 30. These values may then be used to automatically calculate or manually determine a set point for a high current alarm event that may help identify the presence of solids in the pump chamber 22. For example, in some embodiments, a high current alarm setpoint may be selected at a current value that is just above the normal Maximum current value logged. Alternately, the high current alarm setpoint may be chosen to be a certain percentage greater than the Average current value (e.g., 10% greater than the Average value). In some embodiments, it may be desirable for the setpoint to meet a logical combination of criteria, such as the greater of (a) the Average current value plus 10%, and (b) the Maximum current value logged. Other suitable methods of determining the high current alarm setpoint are contemplated as well.

a. Record last event high amp alarm
b. Record maximum amps in high amp alarm
c. Record minimum amps in high amp alarm
d. Record average amps in high amp alarm
e. Record elapsed time in high amp alarm
f. Record counts for high amp alarms activated
g. Log same information to Internet monitoring service to include Time and Date Stamp and Text, Email, Call Problem 5: Monitoring the Filter. A filter and filter switch, such as filter switch 36, can be used to activate an alarm when the filter needs cleaning. The filter keeps solids from entering the pump chamber 22. As solids build up on the filter over time, the liquid level in first chamber 28 may rise to a point where the filter switch 36 is activated, and an alarm (audible and/or visible) will be triggered to alert the user/homeowner to clean the filter. If the alarm is ignored, the filter will eventually become obstructed/plugged, the sewage level in first chamber 28 will continue to rise, and sewage will back-up into the home 10. Currently available septic systems will activate a filter switch alarm, as just described. However, there is a need for a system that uses data collected by septic system 100 to assist users/homeowners, service providers, and/or local inspection authorities to determine the underlying cause for the filter switch alarm. Potential causes of a filter switch alarm may include, for example: a failing septic system 100, homeowner misuse, inadequate maintenance, or an undersized filter.

Solution 5: During activation of a filter switch alarm (caused by liquid reaching filter switch 36), the control and monitoring system 40 will log data associated with the event. For example, the control and monitoring system 40 may record the Last Filter Alarm total elapsed time. In some embodiments, a user may silence an associated alarm buzzer to acknowledge the alarm condition. The control and monitoring system 40 may, in this condition, flash or continue to flash a colored light (e.g., a yellow colored light) indicating a filter switch alarm, and a text message may be displayed on the display console 42, for example, "Filter Alarm." Maximum time recorded for a filter alarm event, minimum time recorded for a filter alarm event, and average time recorded for filter alarms may be recorded by control and monitoring system 40, for example. This may be useful information because it may help determine whether the user/homeowner acted or is acting promptly to correct the problem after being notified of the filter switch alarm, for example. If the filter switch alarm occurs and the problem is ignored, sewage may backup into the home, or sewage may leak through the tank covers causing sewage to pond on the surface, which is contaminating and harmful to humans, pets, and the environment. The control and monitoring system 40 can record "Total Elapsed Time" and "Counts" associated with all filter alarms which may, in turn, enable others (e.g., service providers, inspection authorities, and others) to analyze the problem and/or correct the problem. For example, homes with relatively low filter switch alarm elapsed times and counts may be determined to be well maintained, and conversely, homes with high elapsed times during filter switch alarms and counts may be determined to be not well maintained.

Summary of Solution 5: Detecting that proper filter maintenance is being performed will prevent premature septic system failures, sewage backup costs, and damage to the environment. This may be accomplished by recording and monitoring data associated with filter switch alarms, including:

a. Totalized Time of last filter alarm
b. Record the Maximum time a filter alarm stayed active
c. Record the Minimum time a filter alarm stayed active
d. Record Average time a filter alarm was active
e. Record total elapsed time of all filter alarms
f. Record counts of filter alarms activated
g. Log same information to Internet monitoring service to include Time and Date Stamp and Text, Email, Call Problem 6: High Level Alarm in Pump Chamber. A high level alarm in pump chamber 22 is designed to be activated when the liquid level in the pump chamber 22 is at a critical high level and danger of sewage backup into the home exists. Alarm float switch 34 will trigger a high level alarm condition at control and monitoring system 40 if the liquid level in pump chamber 22 rises sufficiently to activate alarm float switch 34. (The function of the alarm float switch 34 could alternately be performed using a transducer or a level measuring device to identify the occurrence of a high-level condition at a pre-determined level in pump chamber 22.)

Several scenarios can cause a high liquid level alarm. Several examples of conditions or problems that could lead to a high level alarm being triggered include: pump failure, pump power failure, discharge pump broken, plugged discharge pipe, etc. Currently available systems may activate a high liquid level alarm, but may not provide additional information needed to identify the nature or cause of the problem. There is a need for service providers and/or local inspectors to have additional information in order to diagnose the nature/cause of the high liquid level alarm and to provide corrective measures in an efficient manner. Problems may also arise if a user/homeowner sustains damage (e.g., due to sewage backup) and claims that the installer and/or manufacturer are at fault (e.g., claiming that a sewage backup occurred and the alarm never went off, for example). By recording, monitoring, and applying data associated with the high liquid level alarm events, it may be determined, for example, that the system was indeed in an alarm condition, and how long the event lasted prior to some action being taken by the user/homeowner, and any associated damage claims may be resolved accordingly.

Solution 6: When a high liquid level alarm occurs, control and monitoring system 40 will record: the total elapsed time of the most recent High Level Alarm. (Even if the user silences the alarm buzzer, the control and monitoring system 40 may flash a colored light (e.g., a red light) indicating a high level alarm has occurred and displaying a text message on the display console 42, for example, "High LVL Alarm." In some systems, silencing an audible alarm may result in temporarily silencing the alarm, and the audible alarm may repeat after a predetermined timeout period until the alarm is actually cleared.) Control and monitoring system 40 may also record or report statistical data about other high liquid level alarms, such as Maximum elapsed time for a high level alarm event, Minimum elapsed time for a high level alarm event, and Average elapsed time for high level alarm events. This information may help determine whether the user/homeowner is acting quickly to address the problem. If the problem is ignored, sewage may backup into the home or leak through the tank covers allowing sewage to pond on the surface, which is contaminating and harmful to humans, pets, and the environment. The system also records "Total Elapsed time" and "Counts" all high alarms. Again, this information may help the service provider and inspection authority to investigate and correct the problems. Homes with low alarm elapsed times and counts may be classified as well-maintained, and conversely, homes with long elapsed alarm times and counts may be classified as poorly maintained systems, for example. The system may also record information regarding the electrical usage of pump 30 and pump run times to determine the source or cause of the problem. For example, if data regarding electrical current used by pump 30 is very low or zero during a high liquid level alarm condition, the cause may be identified as a pump power failure. Similarly, data regarding the electrical usage of pump 30 and pump run times during a high level alarm may help identify other conditions, such as a pump failure, pump power failure, discharge pump broken, plugged discharge pipe, etc.

Summary of Solution 6: Detecting and monitoring high liquid level alarm events may help to limit sewage backup damage/costs and damage to the environment by recording and monitoring data including:

a. Totalized Time of last high alarm
b. Record the Maximum time a high alarm stayed active
c. Record the Minimum time a high alarm stayed active
d. Record Average time a high alarm was activated
e. Record total elapsed time of all high alarms
f. Record counts of high alarms activated
g. Log same information to Internet monitoring service to include Time and Date Stamp and Text, Email, Call Problem 7: Pump Failure. In currently available septic systems, a pump failure will typically be detected only following the occurrence of a high level alarm. If the pump fails to turn on, the liquid level will rise and reach alarm float switch 34 at the high-level alarm activation level. At this point, it is not known that a pump failure has occurred, only that the level is now critically high. When a high level alarm condition occurs, a service provider is typically called to remedy the problem. If the underlying cause or failure mode is known, a lot of time and money can be saved by knowing what caused the high level alarm to be activated. For example, if the system could inform the user of the failure mode (such as a failed pump), the service provider may be able to save a trip to inspect the problem, which could save money and time.

Solution 7: The control and monitoring system 40 may determine that pump 30 has failed by data showing that when pump 30 should be running, no pump electrical current is measured or detected. The control and monitoring system 40 may measure and display pump electrical current (Amps) on the display console 42, for example. If the high level alarm float switch 34 is activated and no pump current is detected, the unit may alarm and flash a colored light (e.g., a purple light) and may further display text such as "Pump Failure" on display console 42, for example. Under this combination of conditions (high level alarm with no pump current measured), the cause could potentially be either a failed pump motor or a tripped power breaker that feeds power to the pump 30. If a service provider receives information from the homeowner that a pump failure occurred, they can first check to see if the breaker was inadvertently turned off; if so, it would prevent a costly service call. The service provider could also ask the homeowner to run the pump 30 manually and ask whether the control and monitoring system 40 turned a specific color (e.g., a blue light illuminates) and displayed the proper pump current. If the system goes into another pump fail alarm condition, the service provider would know to bring a new/replacement pump to the home to perform the service. Often, a service provider will drive to a location and do a service call only to have to come back a second time to bring the necessary equipment to fix the problem, which may cost the homeowner additional money.

Summary of Solution 7: A pump failure may be detected by the occurrence of a high level alarm in conjunction with low or zero electrical current used by pump 30. Control and monitoring system 40 may facilitate detection of a pump failure by recording and analyzing the following data:

a. Totalized Time of last pump failure alarm
b. Record the Maximum time a pump failure alarm stayed active
c. Record the Minimum time a pump failure alarm stayed active
d. Record Average time a pump failure alarm was active by taking total elapsed time
divided by number of pump failure alarms
e. Record total elapsed time of all pump failure alarms
f. Record number counts the pump alarm activated
g. Log same information to Internet monitoring service to include Time and Date Stamp and Text, Email, Call Problem 8: In a septic system 100, normal wear and tear of the pump float switch 32 and/or the pump 30 will, at some point, require replacement of the worn or failed pump float switch 32 or pump 30. A user/homeowner may wish to anticipate the end of life for such components and schedule their replacement before a failure occurs, which could lead to sewage backup into the home and the attendant cost of damage and repairs, etc. It may be desirable to know, for example, how many hours and/or cycles (counts) a pump float switch 32 or pump 30 has remaining to estimate or determine the anticipated end of life of these items and plan for their replacement before a failure occurs that could cause costly sewage backup flooding within the home. When a new pump 30 is installed, the pump float switch 32 may not necessarily be replaced with a new float switch at the same time. Conversely a new pump float switch 32 may be installed and connected to work with an existing used pump 30. Thus, a control and monitoring system 40 that records and monitors data pertaining to hours and/or cycles (counts) would preferably track such data independently for the pump float switch 32 versus the pump 30 to thereby help plan for their replacement before a costly failure occurs. This data would also be beneficial in the context of a sale of the home to a new homeowner; the new homeowner would be able to see if the pump float switch 32 and pump 30 are nearly new, half-life, or near the end of their useful life, and can plan accordingly for future expenses. Additionally, a control and monitoring system 40 may also monitor longer-term trends in pump electrical current (amps), for example, to identify upward or downward trends that may also be used to determine if pump 30 is wearing out (e.g., prematurely, for example).

Solution 8: The control and monitoring system 40 records data including pump run statistics (e.g., elapsed pump run times, pump electrical current, etc.) and a pump float switch counter that can be useful in determining when the pump float switch 32 or pump 30 is near their respective ends of life. The historical or accumulated data and statistics for the pump float switch 32 and pump 30 can be reset to zero when either a new pump float switch or pump is installed.

Summary of Solution 8: Monitoring pump statistics and pump float switch statistics can save money when deciding to replace either the pump or pump float switch or both.

a. Record last pump run amps
b. Record maximum pump run amps
c. Record minimum pump run amps
d. Record average pump run amps
e. Record last pump run elapsed time
f. Record maximum pump run elapsed time
g. Record minimum pump run elapsed time
h. Record average pump run elapsed time
i. Record pump run counts
j. Record pump float activated counts
k. Record pump run total gallons pumped
l. Log same information to Internet monitoring service to include Time and Date Stamp and Text, Email, Call Problem 9: Currently available septic systems may use only 3 colors to identify different conditions and/or problems. Typically, the following colors are employed as follows: Green—Power is On, Yellow—Filter Alarm, and Red—High Level Alarm. Time and money could be saved in various circumstances if additional different colors and/or text messages were displayed in conjunction with system alarms to further assist the homeowner and service provider to more quickly diagnose problems.

Solution 9: The control and monitoring system 40 can, for example, use "RGB-type" LEDs that are microprocessor-controlled and are able to produce a number of different colors depending on the alarm state or system condition. The control and monitoring system 40 can also use a text indication on display 42 to help diagnose system problems with descriptive text. By knowing more about the problem or condition as early as possible, the service provider can be better prepared and correct the problem more quickly and/or efficiently, saving the homeowner and service provider time and money.

Summary of Solution 9: Using a combination of different colored alarm LEDs and text display messages to quickly notify the homeowner of septic system problems and conditions, thereby saving time and money. Examples may include:

a. Green continuous—Power on, System Normal
b. Blue continuous—pump is running
c. Red/Blue Alternating—Extended Pump Alarm
d. Purple/Blue Alternating—High Pump Amp Alarm
e. Purple Flashing—Pump Failure
f. Purple/Red Alternating—Pump Failure/High Level Alarm
g. Red Flashing—High Level Alarm
h. Yellow Flashing—Filter Alarm Various examples have been described. These and other variations that would be apparent to those of ordinary skill in this field are within the scope of this disclosure.

What is claimed is:

1. A septic system comprising:

a septic tank configured to receive sewage from a structure;

an effluent receiving area;

a pump configured to move the sewage from the septic tank to the effluent receiving area; and a control and monitoring system configured to:

operate the pump to begin pumping the sewage from the septic tank to the effluent receiving area when a fluid level in the septic tank reaches an upper pump level setting, and continue pumping until the fluid level in the septic tank falls to a lower pump level setting, at which point pumping is discontinued;

measure one or more performance metrics comprising at least one of the following:

an elapsed time of pumping from the upper pump level setting to the lower pump level setting; and a number of events of pumping from the upper pump level setting to the lower pump level setting; and alert a user of a condition of the septic system based on the one or more performance metrics exceeding a predetermined setting.

2. The septic system of claim 1, wherein the septic tank comprises a first chamber and a pump chamber, and wherein the pump is disposed in the pump chamber.

3. The septic system of claim 2, wherein the fluid level associated with the upper pump level setting and the lower pump level setting is measured in the pump chamber of the septic tank.

4. The septic system of claim 1, wherein the one or more performance metrics further comprises an electrical current used by the pump when pumping from the upper pump level setting to the lower pump level setting, and wherein the septic system further comprises a processor configured to store data regarding the one or more performance metrics, and to alert the user when the one or more performance metrics exceeds the predetermined setting.

5. The septic system of claim 4 wherein the processor is further configured to calculate additional information based on the one or more performance metrics.

6. The septic system of claim 5 wherein the additional information calculated by the processor comprises one or more of an average value, a maximum value, a minimum value, and an event counter associated with the one or more performance metrics.

7. The septic system of claim 6 wherein the additional information about the one or more performance metrics further comprises identifying an alarm condition based upon a variance of the one or more performance metrics from the average value, the maximum value, the minimum value, the event counter, or a logical combination thereof, wherein the variance is greater than a predetermined threshold.

8. The septic system of claim 1 wherein alerting the user of the condition of the septic system comprises providing an audible alarm.

9. The septic system of claim 1 wherein alerting the user of the condition of the septic system comprises providing a visible alarm.

10. The septic system of claim 9 wherein the visible alarm comprises one or more of the following: a colored light, a code, and a text description.

* * * * *